US009181807B2

(12) United States Patent
Kuwabara

(10) Patent No.: US 9,181,807 B2
(45) Date of Patent: Nov. 10, 2015

(54) BLADE MEMBER AND ROTARY MACHINE

(75) Inventor: Masamitsu Kuwabara, Tokyo (JP)

(73) Assignee: MITSUBISHI HITACHI POWER SYSTEMS, LTD., Yokohama-shi (JP)

( * ) Notice: Subject to any disclaimer, the term of this patent is extended or adjusted under 35 U.S.C. 154(b) by 533 days.

(21) Appl. No.: 13/360,014

(22) Filed: Jan. 27, 2012

(65) Prior Publication Data

US 2012/0269615 A1 Oct. 25, 2012

(30) Foreign Application Priority Data

Apr. 22, 2011 (JP) ..... 2011-096459

(51) Int. Cl.
*F01D 5/18* (2006.01)

(52) U.S. Cl.
CPC ..... *F01D 5/186* (2013.01); *F01D 5/187* (2013.01)

(58) Field of Classification Search
CPC ..... F01D 5/186; F01D 5/187; F01D 5/188
USPC ..... 416/95, 96 R, 97 R, 90 R, 92, 232; 415/115
See application file for complete search history.

(56) References Cited

U.S. PATENT DOCUMENTS

| | | | | |
|---|---|---|---|---|
| 4,500,258 | A * | 2/1985 | Dodd et al. | 416/97 R |
| 5,813,836 | A * | 9/1998 | Starkweather | 416/97 R |
| 6,036,440 | A | 3/2000 | Tomita et al. | |
| 6,257,830 | B1 | 7/2001 | Matsuura et al. | |
| 6,481,967 | B2 * | 11/2002 | Tomita et al. | 416/97 R |
| 6,589,010 | B2 * | 7/2003 | Itzel et al. | 415/115 |
| 7,014,424 | B2 * | 3/2006 | Cunha et al. | 416/97 R |
| 2001/0016163 | A1 | 8/2001 | Tomita et al. | |
| 2003/0039537 | A1 | 2/2003 | Itzel et al. | |
| 2004/0202542 | A1 | 10/2004 | Cunha et al. | |
| 2007/0020100 | A1 | 1/2007 | Beeck et al. | |
| 2008/0028606 | A1 | 2/2008 | Krishnakumar et al. | |
| 2009/0202339 | A1 | 8/2009 | Torii et al. | |

(Continued)

FOREIGN PATENT DOCUMENTS

| | | | |
|---|---|---|---|
| CN | 1776199 | A | 5/2006 |
| EP | 1128024 | A2 | 8/2001 |

(Continued)

OTHER PUBLICATIONS

International Search Report of PCT/JP2012/051655, date of mailing Apr. 24, 2012.

(Continued)

*Primary Examiner* — Dwayne J White
*Assistant Examiner* — Justin Seabe
(74) *Attorney, Agent, or Firm* — Westerman, Hattori, Daniels & Adrian, LLP

(57) ABSTRACT

The airfoil member of the present invention is provided with an airfoil body, an end wall which is installed at an end part of the airfoil body, a fillet portion which smoothly connects the end part of the airfoil body with the end wall, and a cooling channel which allows a cooling medium to circulate inside the airfoil body and the end wall and in which two main channels are connected so as to bend in a folding manner at a return channel. The return channel is formed so as to run along the fillet portion on a cross section intersecting with a center line of a profile of the airfoil body and also formed in such a manner that the width thereof in the profile thickness direction is greater than the width of the main channel in the profile thickness direction.

8 Claims, 14 Drawing Sheets

(56) References Cited

U.S. PATENT DOCUMENTS

| | | | |
|---|---|---|---|
| 2009/0324423 | A1 | 12/2009 | Liang |
| 2011/0033305 | A1 | 2/2011 | Ahmad et al. |

FOREIGN PATENT DOCUMENTS

| | | | |
|---|---|---|---|
| GB | 2452327 | A | 3/2009 |
| JP | 8-144704 | A | 6/1996 |
| JP | 10-280904 | A | 10/1998 |
| JP | 10-299409 | A | 11/1998 |
| JP | 10-339104 | A | 12/1998 |
| JP | 11-22404 | A | 1/1999 |
| JP | 2001-234703 | A | 8/2001 |
| JP | 2003-120208 | A | 4/2003 |
| JP | 2003-314203 | A | 11/2003 |
| JP | 2004-308659 | A | 11/2004 |
| JP | 2006-170198 | A | 6/2006 |
| JP | 2008-031995 | A | 2/2008 |
| JP | 2008-202547 | A | 9/2008 |
| JP | 2009-503331 | A | 1/2009 |
| KR | 10-2003-0019098 | A | 3/2003 |
| WO | 2009/106462 | A1 | 9/2009 |

OTHER PUBLICATIONS

Written Opinion of the International Searching Authority of PCT/JP2012/051655, date of mailing Apr. 24, 2012.

Extended European Search Report dated Sep. 11, 2014, issued in corresponding EP application No. 12774338.3 (6 pages).

Korean Office Action dated Sep. 19, 2014, issued in corresponding KR applicaton No. 10-2013-7024377 with English translation (8 pages).

Chinese Office Action dated Sep. 24, 2014, issued in corresponding CN application No. 201280014878.X with English partial translation (10 pages).

Office Action dated Aug. 4, 2015, issued in counterpart Japanese application No. 2014-219316 (w/English trans) (4 pages).

* cited by examiner

BLADE MEMBER AND ROTARY MACHINE

TECHNICAL FIELD

The present invention relates to an airfoil member and a rotary machine.

The present application claims the right of priority to Japanese Patent Application No. 2011-096459 filed on Apr. 22, 2011, in Japan, with the content cited herewith.

BACKGROUND ART

As is well known, there is an airfoil member as one of the most important elements in a rotary machine. For example, an airfoil member installed on a stator side performs as a turbine vane for rectifying a working fluid. Further, an airfoil member installed on a rotor side performs as a turbine blade for recovering energy from a working fluid and imparting energy to the working fluid.

Where the above-described airfoil member is used in a high-temperature environment, it is necessary to cool the airfoil member for suppressing oxidation-caused thinning and fatigue of the airfoil member.

For example, a turbine vane described in Patent Document 1 given below is provided with an airfoil body extending in a radial direction of a turbine and an end wall which is formed at the tip end of the airfoil body to extend so as to intersect in the radial direction of the turbine. Inside the airfoil body, a serpentine channel is formed which connects in a meandering manner with a plurality of cooling channels extending in the radial direction of the turbine. Then, cooling air is allowed to circulate into the serpentine channel, thereby cooling the airfoil member.

A turbine blade which has adopted a similar cooling channel is described in Patent Document 2 given below.

PRIOR ART DOCUMENTS

Patent Documents

Patent Document 1: Japanese Published Unexamined Patent Application No. H10-299409

Patent Document 2: Japanese Published Unexamined Patent Application No. 2006-170198

SUMMARY OF THE INVENTION

Problems to be Solved by the Invention

Moreover, in the above-described airfoil member, as shown in FIG. 13 and FIG. 14, cooling air c which flows through a serpentine channel 74 cools an airfoil body 70 from the inside.

However, in the above-described airfoil member, there is usually formed a fillet portion 73 which smoothly connects an end part 71 (base portion) of the airfoil body 70 with an end wall 72 (platform) thereof. Therefore, as shown in FIG. 14, around the fillet portion 73, a site is developed with a large blade wall thickness which covers from a return part 75 of the serpentine channel 74 to an outer surface of the fillet portion 73. Thus, there is a possibility that the site having a large blade wall thickness is not sufficiently cooled by the cooling air c.

The present invention has been made in view of the above situation, an object of which is to sufficiently cool a fillet portion.

Means for Solving the Problems

The airfoil member of the present invention is an airfoil member which is provided with an airfoil body, an end wall which is installed at an end portion of the airfoil body in a blade span direction and extends so as to intersect in the blade span direction, a fillet portion which smoothly connects the end portion of the airfoil body with the end wall, and a cooling channel which allows a cooling medium to circulate inside the airfoil body and the end wall and in which two main channels extending along the blade span direction are connected so as to bend in a folding manner at a return channel formed on the end wall side. The return channel is formed so as to run along the fillet portion on a cross section intersecting with a center line of a profile of the airfoil body and also formed in such a manner that the width thereof in a profile thickness direction of the blade is greater than the width of the main channel in the profile thickness direction.

According to the above constitution, since the return channel is formed so as to run along the fillet portion on the cross section intersecting with the center line of the blade profile, from the return channel to the outer surface of the fillet portion has a substantially uniform thickness. It is, thereby, possible to prevent formation of a site which is increased in blade wall thickness and give uniform and sufficient cooling to the fillet portion.

Further, the return channel may be provided on an inner surface of the return channel with a cooling face which is formed along an outer surface of the fillet portion.

Accordingly, the cooling face is provided, by which the fillet portion that is opposite to the cooling face can be cooled more sufficiently.

Further, the return channel may be provided with a projection part which is formed at the center of the airfoil body in the profile thickness direction to guide the flow of the cooling medium to both sides in the profile thickness direction.

Accordingly, the projection part is provided, by which the cooling medium can be guided to both sides in the profile thickness direction. Thereby, it is possible to cool sufficiently the fillet portion positioned on both sides of the return channel in the profile thickness direction.

Further, the return channel may be provided with a cooling hole on a partition wall from an upstream side channel of the main channel which is positioned on the upstream side in the return channel.

Accordingly, compressed air flowing in the proximity of the cooling face of the return channel is exchanged, by which the cooling face is further improved in cooling capability.

Further, the cooling face may be formed in such a manner that a distance of the cooling face from the outer surface of the fillet portion is substantially the same distance from the outer surface of the airfoil body to the inner surface of the main channel.

Accordingly, the distance of the cooling face from the outer surface of the fillet portion is formed so as to be substantially the same distance from the outer surface of the airfoil body to the inner surface of the main channel, thus making it possible to provide uniform cooling between the airfoil body and the fillet portion.

Still further, the cooling face may extend along the center line of the blade profile.

Accordingly, since the cooling face extends along the center line of the blade profile, it is possible to give uniform and sufficient cooling to the fillet portion over a wide range along the center line of the blade profile.

In addition, a rotary machine of the present invention is provided with the above-described airfoil member.

Accordingly, the above-described airfoil member is provided, by which the airfoil member can be enhanced in cooling effect to provide a highly reliable rotary machine.

Effects of the Invention

The airfoil member of the present invention is able to give uniform and sufficient cooling to the fillet portion.

Further, the rotary machine of the present invention can be improved in reliability.

MODE FOR CARRYING OUT THE INVENTION

Hereinafter, a description will be given of embodiments of the present invention with reference to the drawings.

First Embodiment

Figure 1:
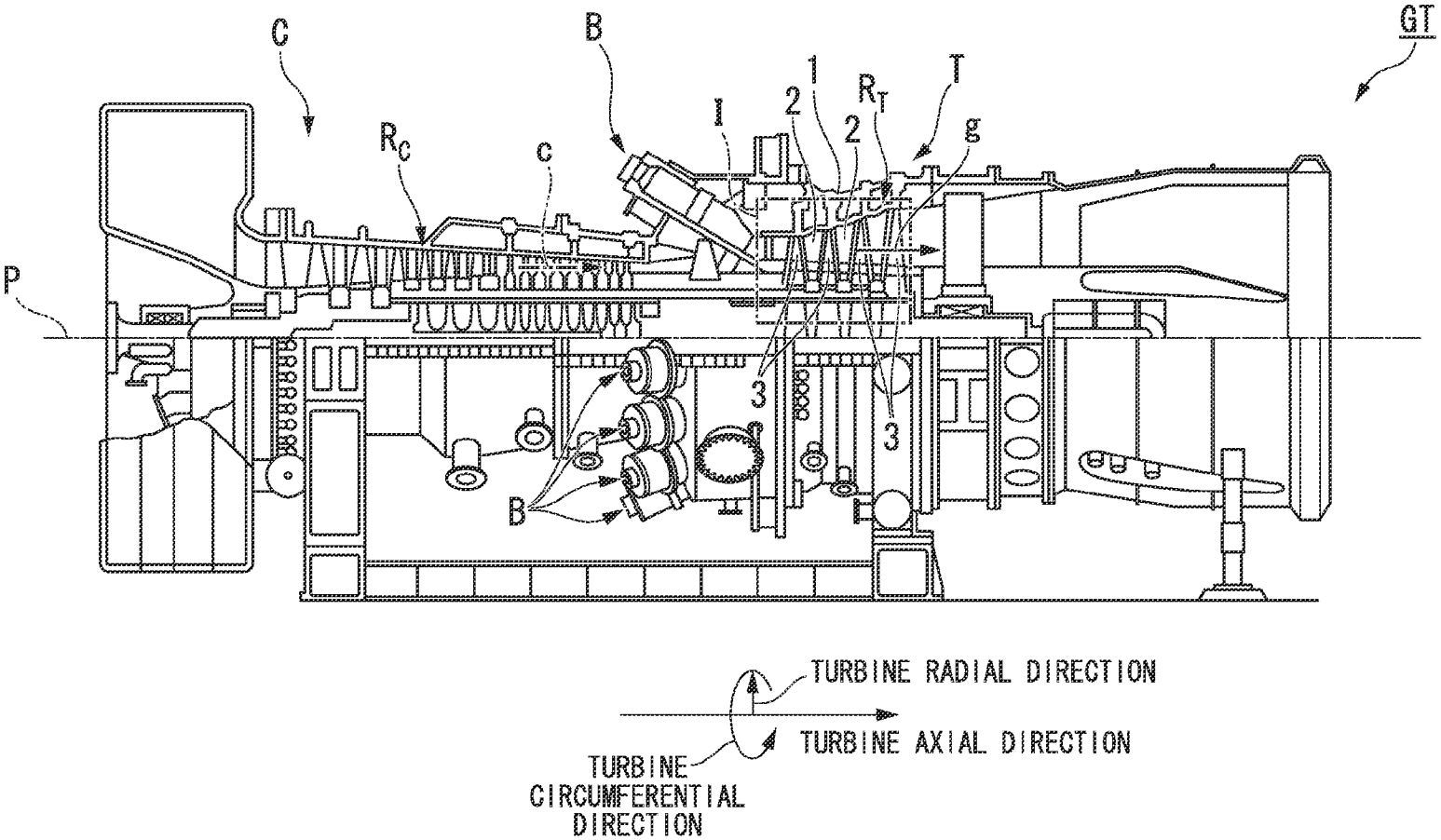
FIG. 1 is a half sectional view which shows a schematic constitution of a gas turbine GT related to a first embodiment of the present invention.

FIG. 1 is a half sectional view which shows a schematic constitution of the gas turbine (rotary machine) GT related to the first embodiment of the present invention. As shown in FIG. 1, the gas turbine GT is provided with a compressor C for generating compressed air (cooling medium) c, a plurality of combustors B for generating combustion gas g by supplying a fuel to the compressed air c supplied from the compressor C, and a turbine (rotary machine) T for obtaining rotary power from the combustion gas g supplied from the combustors B.

In the gas turbine GT, a rotor $R_c$ of the compressor C and a rotor $R_T$ of the turbine T are coupled at the shaft ends to extend above a turbine axis P.

In the following description, an extending direction of the rotor $R_T$ is referred to as a turbine axial direction, a circumferential direction of the rotor $R_T$ is referred to as a turbine circumferential direction, and a radial direction of the rotor $R_T$ is referred to as a turbine radial direction.

Figure 2:
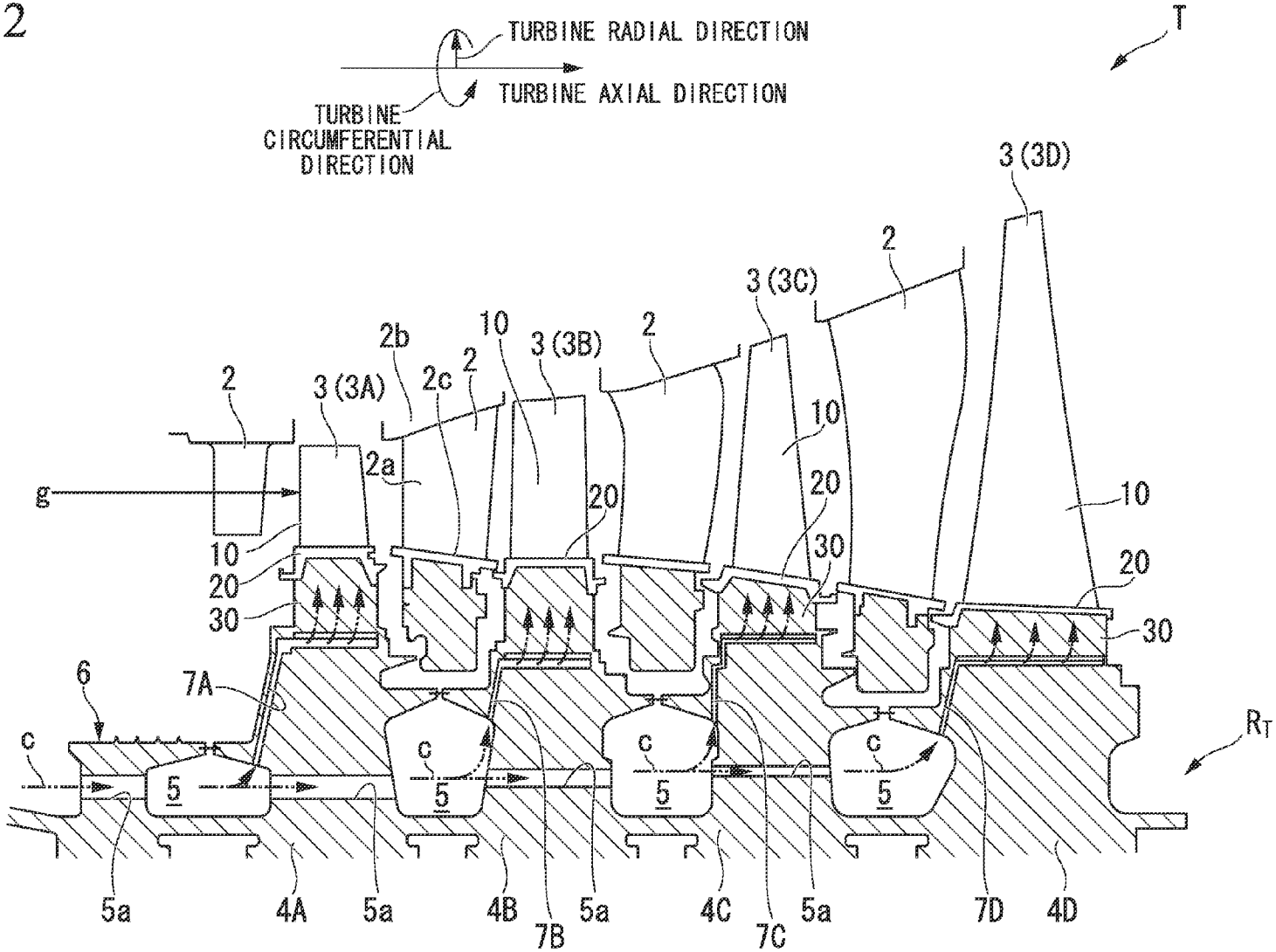
FIG. 2 is an enlarged sectional view which shows a major part of a turbine T related to the first embodiment of the present invention, and an enlarged view of a major part I in FIG. 1.

FIG. 2 is an enlarged sectional view which shows a major part of the turbine T, and an enlarged view which shows the major part I in FIG. 1.

As shown in FIG. 2, the turbine T is provided with turbine vanes 2 and turbine blades (airfoil members) 3 which are disposed alternately at four stages inside a turbine casing 1 in the turbine axial direction. The turbine vanes 2 at each stage constitute an annular turbine vane array, with an interval kept in the turbine circumferential direction, each of which is fixed to the turbine casing 1 and extends toward the rotor $R_T$.

In a similar manner, the turbine blades 3 at each stage constitute an annular turbine blade array, with an interval kept in the turbine circumferential direction. They are fixed to rotor disks 4A to 4D of the rotor $R_T$ and also extend toward the turbine casing 1.

As shown in FIG. 2, the rotor $R_T$ is provided with the rotor disks 4A to 4D which are stacked in the turbine axial direction and formed in a shaft shape viewed as a whole. First to fourth-stage turbine blades 3A to 3D are respectively fixed to the outer circumferences by these rotor disks 4A to 4D. In the following description, where the reference numerals 3A to 3D, 4A to 4D, and 7A to 7D specify individual items, an uppercase letter follows the reference numeral. Where they do not specify individual items, an uppercase letter is omitted.

Of the rotor disks 4A to 4D, between two disks adjacent in the turbine axial direction, a manifold 5 is formed which extends in the turbine circumferential direction. A seal disk 6, the center axis of which is pointed at the turbine axial direction, is connected to the rotor disk 4A on the upstream side of the first-stage rotor disk 4A, and the manifold 5 is formed between the seal disk 6 and the rotor disk 4A.

These manifolds 5 are continuously connected via a connection hole 5*a* drilled on each of the rotor disks 4A to 4C and the seal disk 6. Compressed air c extracted from the compressor C flows sequentially from the seal disk 6 side to each of the manifolds 5.

Further, the rotor disks 4A to 4D are respectively formed with radial holes 7A to 7D for guiding the compressed air c from each of the manifolds 5 on the upstream side to a cooling channel 50 (refer to FIG. 3) formed inside each of the turbine blades 3A to 3D. These radial holes 7A to 7D are formed in a multiple number respectively on the rotor disks 4A to 4D, with an interval kept in the turbine circumferential direction.

Figure 3:
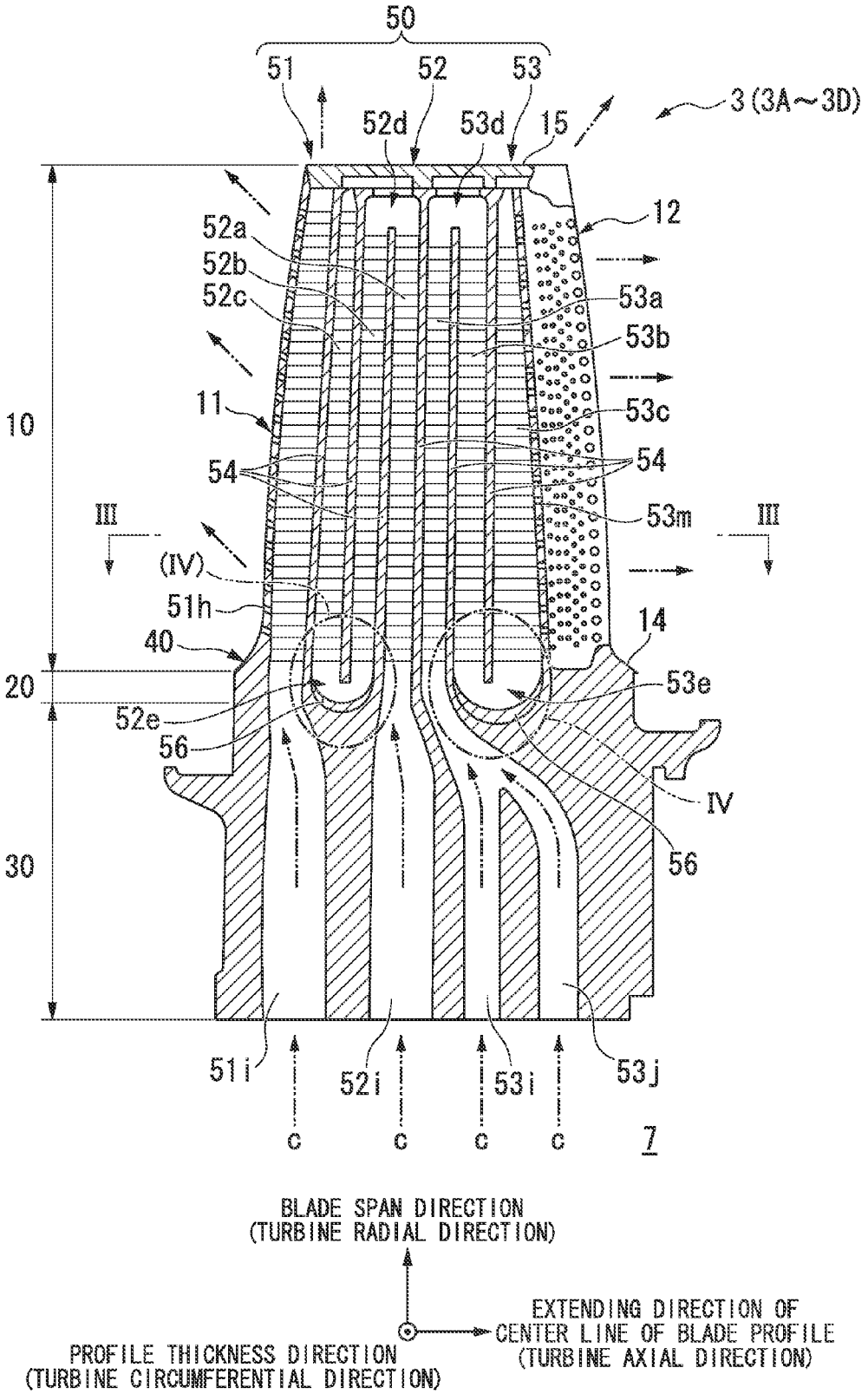
FIG. 3 is a sectional view which shows a turbine blade 3 related to the first embodiment of the present invention that is cut along a center line Q of the blade profile and a sectional view taken along line II to II in FIG. 4.
Figure 4:
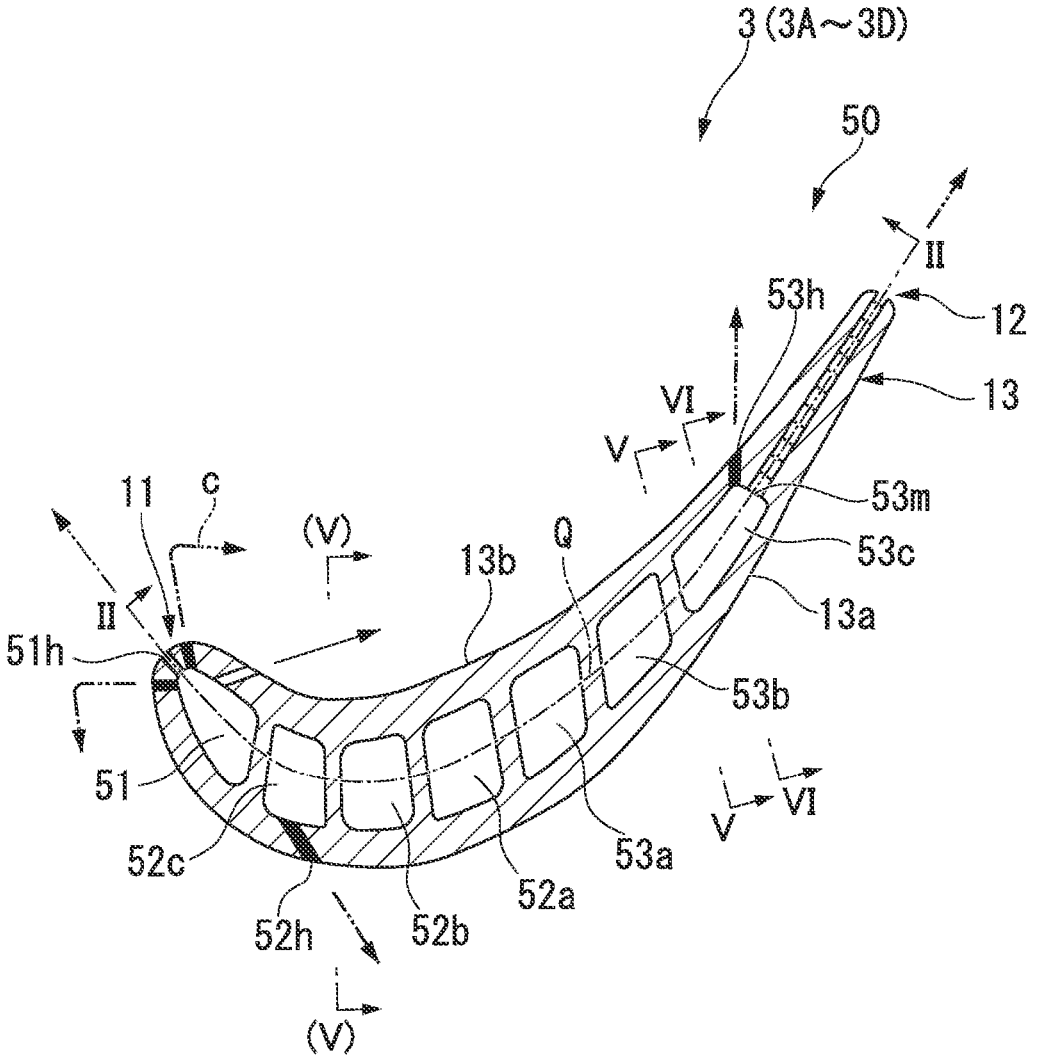
FIG. 4 is a blade shape sectional view which intersects in the blade span direction with the turbine blade 3 related to the first embodiment of the present invention, and a sectional view taken along line III to III in FIG. 3.
Figure 4:
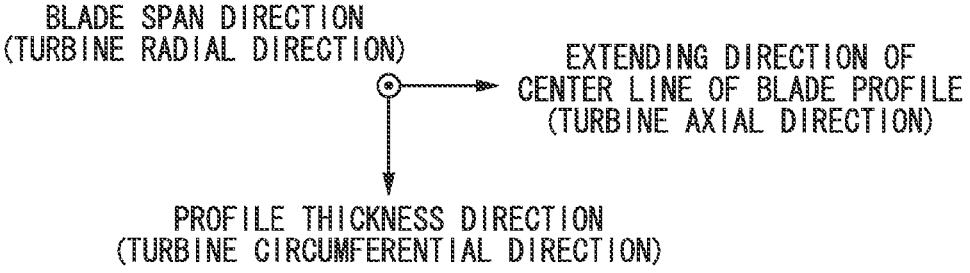

FIG. 3 is a sectional view which is cut along the center line Q of the profile of the turbine blade 3 (sectional view taken along line II to II in FIG. 4), and FIG. 4 is a blade shape sectional view which intersects with the turbine blade 3 in the blade span direction (sectional view taken along line III to III in FIG. 3).

As shown in FIG. 3, the turbine blade 3 is constituted continuously with the airfoil body 10, the platform (end wall) 20 and a blade basement 30 from the other side of the airfoil body 10 in the blade span direction to one side thereof in the above-described order.

As shown in FIG. 3, the airfoil body 10 turns the blade span direction to the turbine radial direction and extends, as shown in FIG. 2, from a base end (end part) 14 formed on the rotor disks 4 (4A to 4D) side (shown in FIG. 3) to a tip end 15 positioned on the turbine casing 1.

Further, as shown in FIG. 4, the airfoil body 10 turns the profile thickness direction of the blade to the turbine circumferential direction. On the blade-shape cross section intersecting in the blade span direction, a leading edge 11 is formed in a round shape, while a trailing edge 12 is formed in a pointed shape. Still further, as shown in FIG. 4, the airfoil body 10 is formed with a suction side 13*a* which is formed in a raised shape on a blade surface 13 on one side in the turbine circumferential direction and a pressure side 13*b* which is formed in a recessed shape on the other side in the turbine circumferential direction.

As shown in FIG. 3, the platform 20 is formed so as to continue to one side in the turbine axial direction with respect to the base end 14 of the airfoil body 10, extending so as to intersect in the blade span direction.

The platform 20 is smoothly connected to the base end 14 of the airfoil body 10 at a fillet portion 40. The fillet portion 40 is formed in a circumferential manner along a contour of the blade-shape cross section of the base end 14, and a cross sectional contour which is cut along the blade span direction assumes a quarter-round arc shape (refer to FIG. 6 and FIG. 7).

As shown in FIG. 3, the blade basement 30 is formed so as to continue to one side in the turbine radial direction (close to turbine axis P) with respect to the platform 20 and formed, for example, in the shape of a Christmas tree or in the shape of a triangle shape. The blade basement 30 is fitted into a groove of the blade basement (not shown) formed on an outer circumference of the rotor disk 4 and restrained by an outer circumference part of the rotor disk 4 (refer to FIG. 2).

The cooling channel 50 is formed inside the above-constituted turbine blade 3.

As shown in FIG. 3 and FIG. 4, the cooling channel 50 is provided with a leading edge-side channel 51 and serpentine channels 52, 53 which are arranged sequentially from the leading edge 11 to the trailing edge 12.

The leading edge-side channel 51 extends in the blade span direction from the blade basement 30 to the tip end 15 of the airfoil body 10 on the leading edge 11 side to which the leading edge-side channel 51 is closer than the serpentine channels 52, 53. The leading edge-side channel 51 is connected at an upstream end thereof to an introduction channel 51*i* communicatively connected to a radial hole 7 (refer to FIG. 2). Further, the leading edge-side channel 51 is communicatively connected to a plurality of cooling holes 51*h*, each of which penetrates through a blade surface 13 of the leading edge 11 and a channel wall face of the leading edge-side channel 51.

The leading edge-side channel 51 cools the leading edge 11 by using the compressed air c which flows from the radial hole 7 to the tip end 15 of the airfoil body 10 and allows the compressed air c to flow through the cooling hole 51*h*, thereby subjecting the leading edge 11 to shower-head film cooling.

As shown in FIG. 3 and FIG. 4, the serpentine channel 52 is formed in a meandering manner between the leading edge-side channel 51 and the serpentine channel 53 so as to be positioned on the center line Q of the blade profile (refer to FIG. 3) and connected with return channels 52*d*, 52*e* at which three main channels 52*a* to 52*c*, each of which extends in the blade span direction, are formed in a U shape.

Each of the three main channels 52*a* to 52*c* extends from the tip end 15 of the airfoil body 10 to the base end 14 of the airfoil body 10. Also, these main channels are installed in parallel from the trailing edge 12 side to the leading edge 11 side in the above-described order. Then, an outer circumference end of the main channel 52*a* is connected to an outer circumference end of the main channel 52*b* at a return channel 52*d*, and an inner circumference end of the main channel 52*b* is connected to an inner circumference end of the main channel 52*c* at a return channel 52*e*. Further, the main channel 52*a* is connected at the upstream end thereof to the introduction channel 52*i* communicatively connected to the radial hole 7 (refer to FIG. 2). Still further, the main channel 52*c* is communicatively connected to a plurality of cooling holes 52*h*, each of which penetrates through the blade surface 13 and a channel inner wall of the main channel 52*c*.

In the serpentine channel 52, the compressed air c flows from the introduction channel 52*i* into the main channel 52*a*, thereafter, passing through the main channel 52*a*, turning at 180° at the return channel 52*d*, flowing into the main channel 52*b*, passing through the main channel 52*b*, turning at 180° at the return channel 52*e*, and flowing into the main channel 52*c*. In the above-described course, part of the compressed air c which circulates inside the main channel 52*c* flows out obliquely from the cooling hole 52*h* as shown in FIG. 4, thereby subjecting the blade surface 13 to film cooling.

As shown in FIG. 3 and FIG. 4, the serpentine channel 53 is formed in a meandering manner on the trailing edge 12 side so as to be positioned on the center line Q of the blade profile (refer to FIG. 3), and three main channels 53*a* to 53*c* extending in the blade span direction are connected at the return channels 53*d*, 53*e* formed in a U shape.

Each of the three main channels 53*a* to 53*c* extends from the tip end 15 of the airfoil body 10 to the base end 14 of the airfoil body 10 and installed in parallel from the leading edge 11 side to the trailing edge 12 side in the above-described order. Then, an outer circumference end of the main channel 53*a* is connected to an outer circumference end of the main channel 53*b* at the return channel 53*d*, and an inner circumference end of the main channel 53*b* is connected to an inner circumference end of the main channel 53*c* at the return channel 53*e*. Further, the main channel 53*a* is connected at the upstream end thereof to introduction channels 53*i*, 53*j* communicatively connected to the radial hole 7. Still further, as shown in FIG. 4, the main channel 53*c* is communicatively connected to a plurality of cooling holes 53*h*, each of which penetrates through the blade surface 13 and the main channel 53*c*.

In the serpentine channel 53, the compressed air c flows from the introduction channels 53*i*, 53*j* into the main channel 53*a*, thereafter, passing through the main channel 53*a*, turning at 180° at the return channel 53*d*, flowing into the main channel 53*b*, passing through the main channel 53*b*, turning at 180° at the return channel 53*e*, and flowing into the main channel 53*c*. In the above-described course, part of the compressed air c which circulates inside the main channel 53*c* flows out to the surface through the cooling hole 53*h* to conduct film cooling, and the remainder of the compressed air c cools a pin fin at the trailing edge end when flowing out from the trailing edge 12.

The compressed air c passes from the introduction channels 53*i*, 53*j* through the main channels 53*a*, 53*b*, 53*c* and the return channels 53*d*, 53*e* at the serpentine channel 53 and is finally discharged into combustion gas. In the course of flowing through the channels by returning to the return channels 53*d*, 53*e*, the compressed air c undergoes pressure loss and thereby gradually decreases in pressure.

In the turbine blade 3 which has been described as being constituted as above, the above-described return channels 52*e*, 53*e* are formed between the base end 14 of the airfoil body 10 and the platform 20 at the fillet portion 40 in the turbine radial direction. The return channels 52*e*, 53*e* are formed along the fillet portion 40 on a cross section intersecting with the center line Q of the blade profile.

The return channels 52*e*, 53*e* are similar in constitution. Thus, in the following description, the return channel 53*e* will be described with description of the return channel 52*e* omitted.

Figure 5:
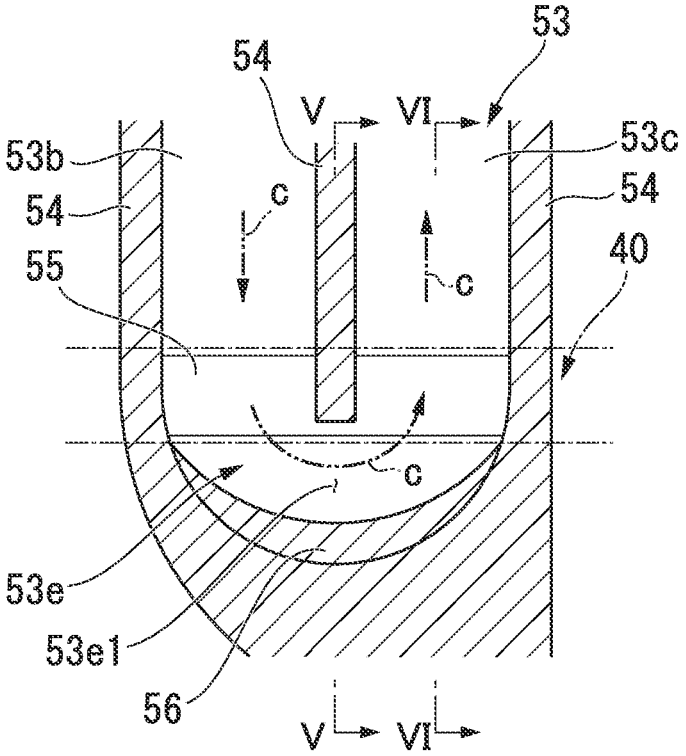
FIG. 5 is an enlarged sectional view which shows a major part of the turbine blade 3 related to the first embodiment of the present invention, and an enlarged view which shows a major part IV in FIG. 3.
Figure 5:
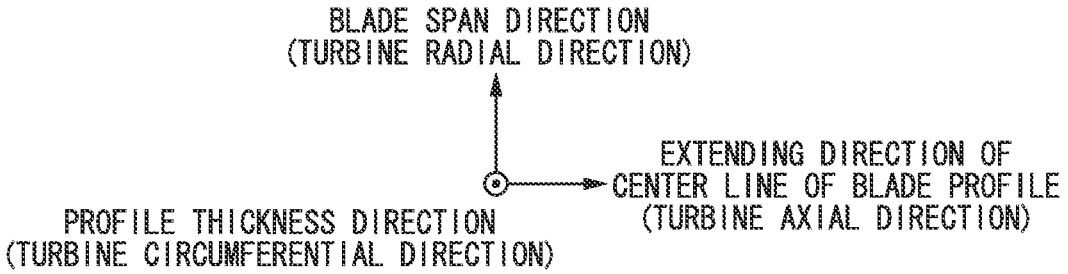
Figure 6:
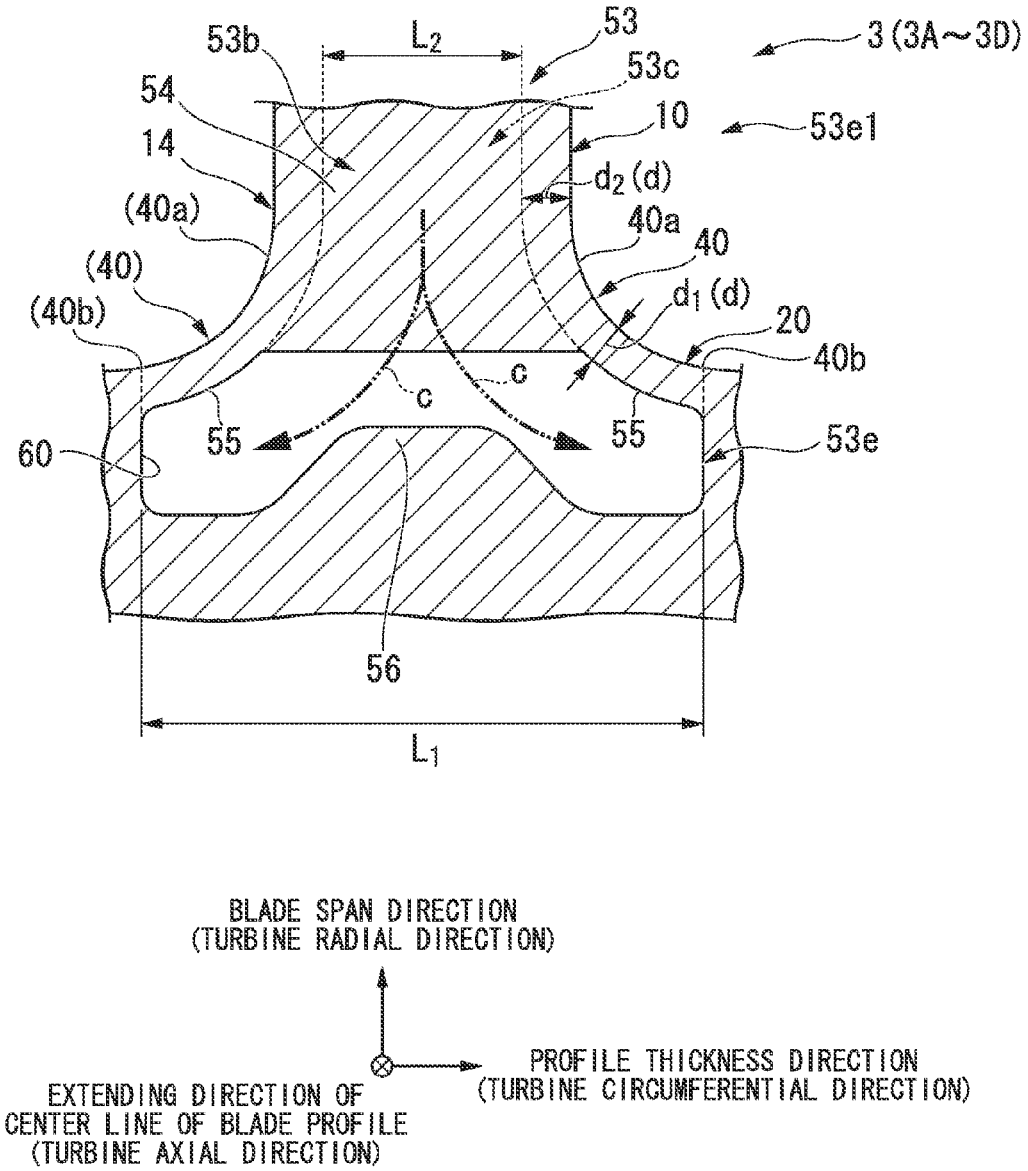
FIG. 6 is a sectional view which intersects with the center line Q of a cooling channel 50 related to the first embodiment of the present invention, and a sectional view taken along line V to V in FIG. 5.
Figure 7:
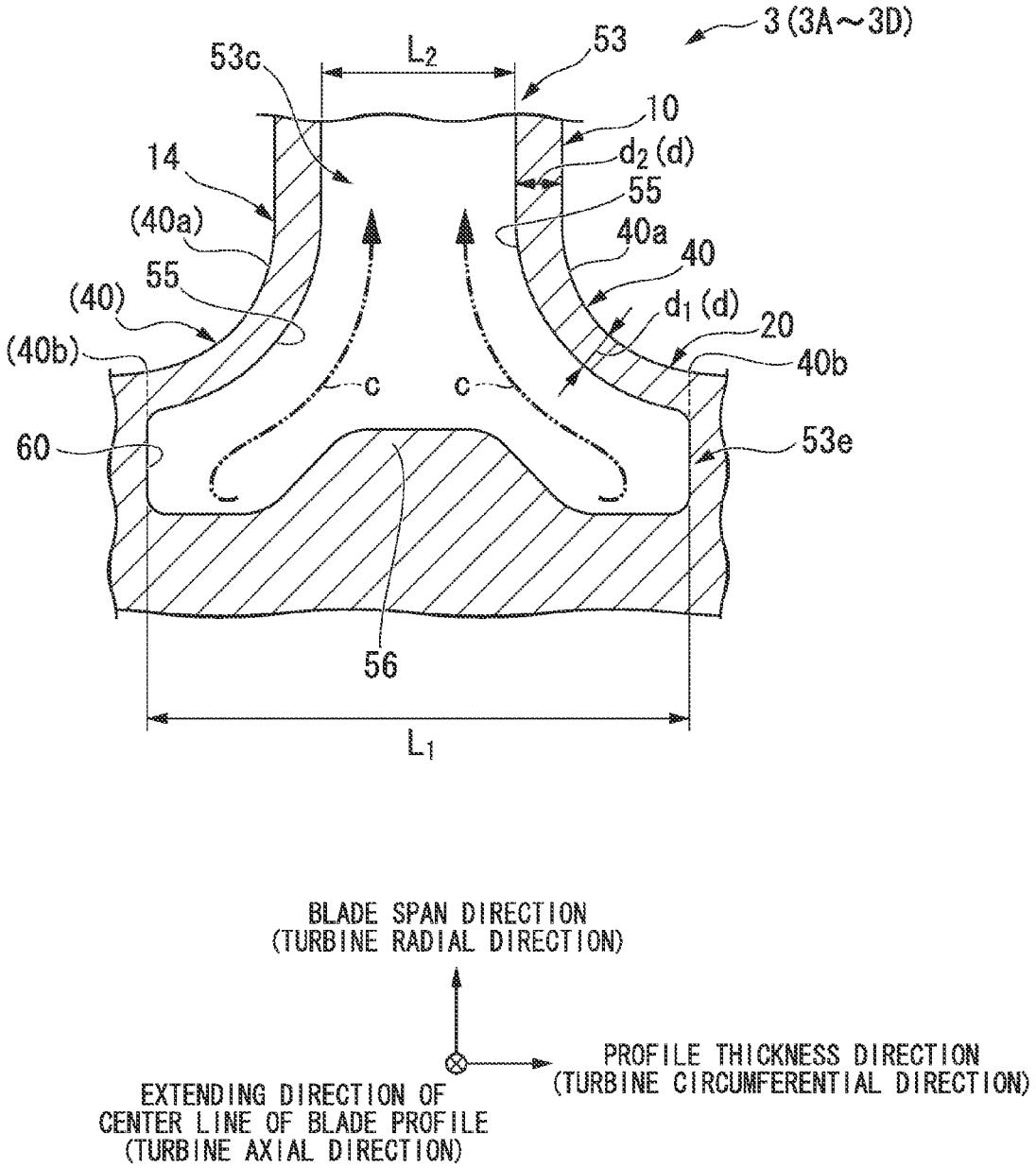
FIG. 7 is a sectional view which intersects with the center line Q of the cooling channel 50 related to the first embodiment of the present invention, and a sectional view taken along line VI to VI in FIG. 5.

FIG. 5 is an enlarged view which shows a major part in FIG. 3 (enlarged view showing a major part IV in FIG. 3), FIG. 6 is a sectional view taken along line V to V in FIG. 5, and FIG. 7 is a sectional view taken along line VI to VI in FIG. 5.

As shown in FIG. 6 and FIG. 7, the return channel 53*e* is formed on a cross section orthogonal to the center line Q of the blade profile (hereinafter, simply referred to as an intersecting cross section of the center line Q of the blade profile) so as to be greater in length L in the profile thickness direction than the main channel 53*b* and the main channel 53*c* ($L_1 > L_2$). Further, as shown in FIG. 6, the return channel 53*e* is formed on the intersecting cross section of the center line Q of the blade profile so as to assume a flat shape in which the length in the blade span direction is smaller than the length L1 in the profile thickness direction.

As shown in FIG. 5, the cooling face 55 is formed along an outer surface 40*a* of the fillet portion 40 on both sides in the profile thickness direction at the channel inner wall face (inner surface) of the return channel 53*e*.

The cooling face 55 extends along the center line Q of the blade profile and is also formed, as shown in FIG. 6 and FIG. 7, in a circular arc shape along the outer surface 40*a* of the fillet portion 40 formed in a quarter-round arc shape at the intersecting cross section. More specifically, as shown in FIG. 7, the cooling face 55 is provided with a cross section contour formed in a quarter-round arc shape along the fillet portion 40 at the intersecting cross section of the center line Q of the blade profile at a position in the front and back of the partition wall 54 which separates the main channel 53*b* from the main channel 53*c* and, as shown in FIG. 6, also provided with a cross section contour which is formed in a small circular-arc shape along the fillet portion 40 at a position which includes the partition wall 54 (intermediate portion 53*e*1).

As shown in FIG. 6 and FIG. 7, it is desirable that a channel inner wall 60 which forms a channel width ($L_1$) of the return channel 53*e* is increased in width substantially up to the proximity of an outer edge 40*b* of the fillet portion 40. At the center of the center line Q of the blade profile, the channel width ($L_1$) is increased in width up to the proximity of the outer edge 40*b* of the fillet portion 40 toward both sides in the profile thickness direction, by which the cooling face 55 is enlarged along the fillet portion 40 in the profile thickness direction. The outer edge 40*b* of the fillet portion 40 refers to a boundary line between the fillet portion 40 and the surface of the platform 20.

Further, where a distance between the outer surface of the turbine blade 3 and the channel inner wall face of the cooling channel 50 in a normal line direction of the outer surface of the turbine blade 3 is defined as a blade wall thickness d, a blade wall thickness $d_1$ between the cooling face 55 and the fillet portion 40 is formed so as to be substantially the same at respective sites.

Still further, the blade wall thickness $d_1$ between the cooling face 55 and the fillet portion 40 is formed so as to be substantially equal to a blade wall thickness $d_2$ of the main channel 53*b* and that of the main channel 53*c*.

In addition, on the blade basement 30 side of the channel inner wall face of the return channel 53*e*, a projection part 56 is formed which projects in the normal line direction of the channel inner wall face at the center in the profile thickness direction. As shown in FIG. 6, the projection part 56 is formed in a trapezoidal shape on each intersecting cross section of the center line Q of the blade profile. As shown in FIG. 5, the projection part 56 projects in a gradually increasing amount moving from the main channel 53*b* side to the intermediate portion 53*e*1 on the return channel 53*e* and, thereafter, projects in a gradually decreasing amount moving from the intermediate portion 53*e*1 to the main channel 53*c*.

In addition to guiding the compressed air c as will be described below, the projection part 56 also adjusts a channel cross section of the return channel 53*e*. In the present embodiment, the projection part 56 is provided due to the channel width ($L_1$) of the return channel 53*e* being, as described above, increased in width in the profile thickness direction, by which the compressed air c flows at the center of the return channel 53*e* and prevents the occurrence of stagnation of flow in the proximity of the channel inner wall 60 of the intermediate portion 53*e*1, securing uniform flow of the compressed air c of the channel cross section.

Next, a description will be given of actions of the turbine blade 3 in the above-constituted gas turbine GT.

As described above, when flowing into the serpentine channel 53 via the introduction channels 53*i*, 53*j*, the compressed air c passes through the main channel 53*a*, turns at 180° at the return channel 53*d*, flows into the main channel 53*b*, passes through the main channel 53*b*, turns at 180° at the return channel 53*e*, and flows into the main channel 53*c*.

Since the cooling face 55 is formed so as to be substantially uniform in blade wall thickness $d_1$, the compressed air c passing through the return channel 53*e* removes heat uniformly at sites of the fillet portion 40.

That is, as shown in FIG. 5, the compressed air c gives uniform cooling to the sites of the fillet portion 40 over a direction at which the center line Q of the blade profile extends. Further, on each intersecting cross section of the center line Q of the blade profile (refer to FIG. 6 and FIG. 7), the channel width ($L_1$) is increased in width up to the proximity of the outer edge of the fillet portion 40, thus making it possible to cool the sites uniformly over the blade span direction of the fillet portion 40 and in the profile thickness direction thereof.

Further, the compressed air c which has reached the upstream end of the projection part 56 on the return channel 53*e* is gradually guided to both sides in the profile thickness direction, because the projection part 56 projects in an increasing amount moving to the intermediate portion 53*e*1. In the return channel 53*e*, the compressed air c guided to both sides in the profile thickness direction carries out cooling mainly via the cooling face 55 by removing heat from the fillet portion 40.

Still further, the projection part 56 is adjusted for projection amount, thus making it possible to improve uneven flowing of the compressed air c on the channel cross section of the return channel 53*e*.

As so far described, according to the turbine blade 3 used in the gas turbine GT, the return channel 53*e* is formed so as to run along the fillet portion 40 on the intersecting cross section of the center line Q of the blade profile. Therefore, the blade wall thickness d is uniform from the return channel 53*e* to the outer surface 40*a* of the fillet portion 40. Thereby, it is possible to prevent formation of a site which is increased in blade wall thickness d and to give uniform and sufficient cooling to the fillet portion 40. It is, therefore, possible to suppress oxidation-caused thinning and fatigue of the turbine blade 3. A similar effect can be obtained also in the return channel 52*e*.

Further, since the cooling face 55 is provided, it is possible to give sufficient cooling to the fillet portion 40 that is opposite to the cooling face 55.

Further, since the projection part 56 is provided, the compressed air c is guided to both sides in the profile thickness direction. Thereby, it is possible to give sufficient cooling to the fillet portion 40 positioned on both sides of the return channel 53*e* in the profile thickness direction.

Further, a distance of the cooling face 55 to the outer surface 40*a* of the fillet portion 40 is formed so as to be substantially the same distance from the channel inner wall face of the main channel 53*b* to the outer surface of the airfoil body 10 and a distance from the channel inner wall face of the main channel 53*c* to the outer surface of the airfoil body 10. It is, therefore, possible to carry out uniform cooling between the airfoil body 10 and the fillet portion 40.

Still further, the cooling face 55 extends along the center line Q of the blade profile. Therefore, the fillet portion 40 can be uniformly and sufficiently cooled over a wide range along the center line Q of the blade profile.

In addition, the turbine blade 3 is provided, by which the turbine blade 3 can be enhanced in cooling effect to improve the reliability.

Second Embodiment

Hereinafter, a description will be given of the second embodiment of the present invention with reference to drawings. In the following description and the drawings used in the description, constituents similar to those which have been already described will be given the same reference numerals, with overlapping description being omitted.

Figure 8:
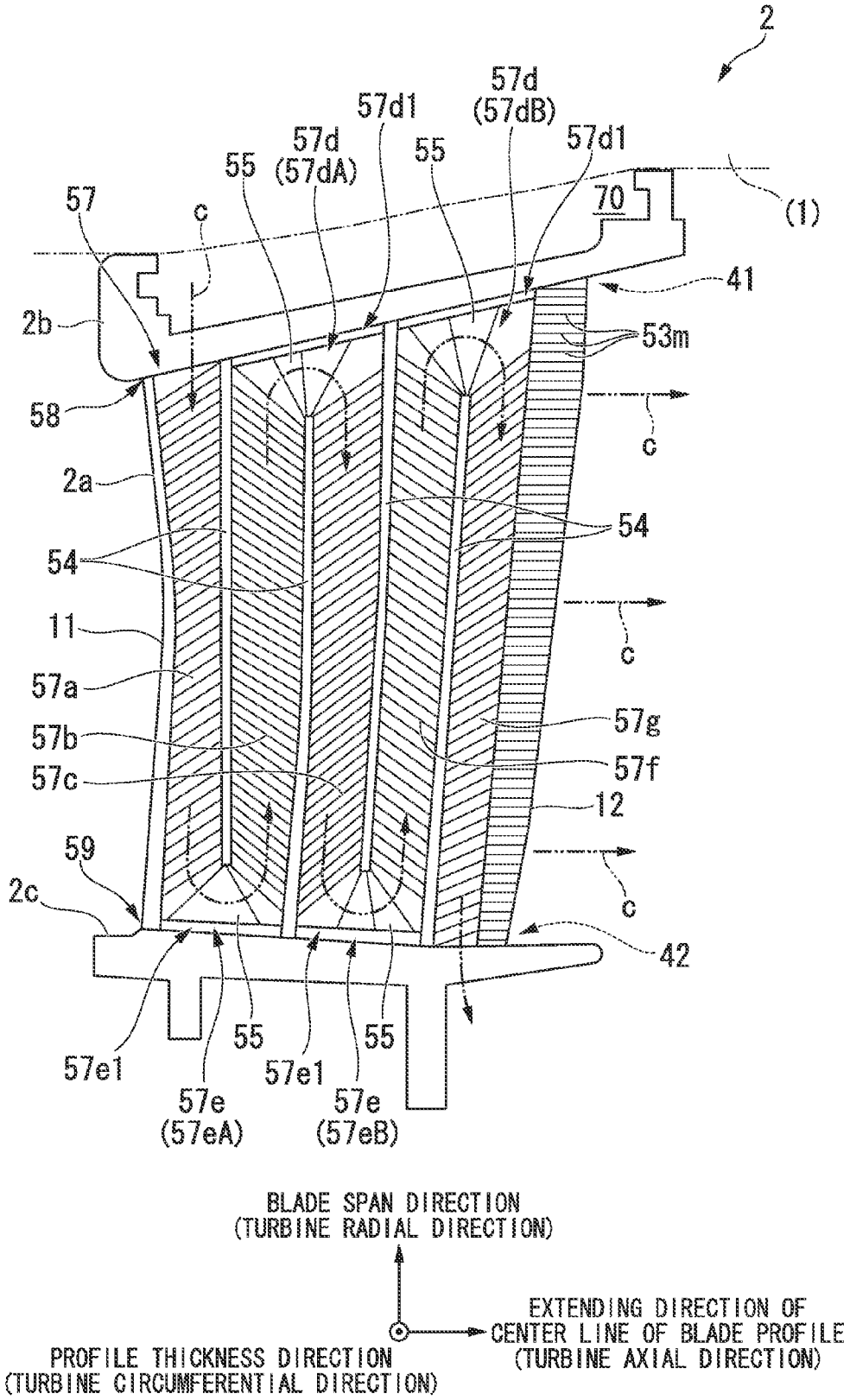
FIG. 8 is a sectional view which shows a turbine vane 2 related to a second embodiment of the present invention that is cut along the center line of the blade profile.

FIG. 8 is a sectional view which is cut along the center line of the profile of a turbine vane 2 of the present embodiment.

In the above-described first embodiment, the present invention is applied to the turbine blade 3. However, in the present embodiment, the present invention is applied to the turbine vane 2 of a turbine T (refer to FIG. 2).

As shown in FIG. 8, an outer shroud (end wall) 2*b* of the turbine vane 2 is connected to a base end 58 of an airfoil body 2*a* (outer side in the turbine radial direction, end part) and an inner shroud (end wall) 2*c* of the turbine vane 2 is connected to a tip end 59 of the airfoil body 2*a* (inside in the turbine radial direction, end part).

The base end 58 of the airfoil body 2*a* is smoothly connected to the outer shroud 2*b* at a fillet portion 41, and the tip end 59 of the airfoil body 2*a* is smoothly connected to the inner shroud 2*c* at a fillet portion 42.

A serpentine channel (cooling channel) 57 is formed inside the turbine vane 2.

The serpentine channel 57 is formed in a meandering manner between the leading edge 11 and the trailing edge 12, as shown in FIG. 8, so as to be positioned on the center line Q of the blade profile, as shown in FIG. 4. Five main channels 57*a* to 57*c*, 57*f*, 57*g* extending in the blade span direction are connected at return channels 57*d* (57*d*A, 57*d*B), 57*e* (57*e*A, 57*e*B), each of which is formed in a U shape.

Each of the five main channels 57*a* to 57*c*, 57*f*, 57*g* extends from the base end 58 side of the airfoil body 2*a* to the leading end 59 side of the airfoil body 2*a*, and they are installed in parallel from the leading edge 11 side to the trailing edge 12 side in the above-described order. Then, an inner circumference end of the main channel 57*a* is connected to an inner circumference end of the main channel 57*b* at the return channel 57*e*A, and an outer circumference end of the main channel 57*b* is connected to an outer circumference end of the main channel 57*c* at the return channel 57*d*A. Further, an inner circumference end of the main channel 57*c* is connected to an inner circumference end of the main channel 57*f* at the return channel 57*e*B, and an outer circumference end of the main channel 57*f* is connected to an outer circumference end of the main channel 57*g* at the return channel 57*d*B.

Further, the upstream end of the main channel 57*a* is communicatively connected to a blade ring feed hole 70 to which compressed air c is supplied. The main channel 57*g* which is communicatively connected to a cooling hole 53*m* of the trailing edge 12 gives convection cooling to an end part of the trailing edge and is discharged, thereafter, into combustion gas.

The above-described return channels 57*d* (57*d*A, 57*d*B), 57*e* (57*e*A, 57*e*B) are formed so as to run along the fillet portions 41, 42 on a cross section intersecting with the center line Q of the profile of the airfoil body 2*a*.

More specifically, a cooling face 55 is formed on each of the return channels 57*d* (57*d*A, 57*d*B) and 57*e* (57*e*A, 57*e*B) so as to run along the outer surfaces of the fillet portions 41, 42. Further, at the center of the return channel 57*d* in the profile thickness direction, a projection part 57*d*1 is formed which projects in a normal line direction of the channel inner wall face. At the center of the return channel 57*e* in the profile thickness direction, a projection part 57*e*1 is formed which projects in the normal line direction of the channel inner wall face.

According to the present embodiment, in addition to obtaining the above-described major effects of the first embodiment, it is possible to sufficiently cool the fillet portions 41, 42 of the turbine vane 2.

Action procedures or various shapes and combinations or the like of constituents shown in the above embodiments are only examples and may be changed in various ways based on design requirements and the like, within a scope not departing from the gist of the present invention.

For example, in the above-described first embodiment, the cooling face 55 has been formed on the intersecting cross section of the center line Q of the blade profile so as to give a circular-arc cross section contour and arranged so as to run along the outer surface of the fillet portion 40. However, the cooling face 55 may be formed so as to give a linear cross section contour which extends obliquely in a tangent line direction of the outer surface of the fillet portion 40 and arranged so as to run along the outer surface of the fillet portion 40. This is also the same in the second embodiment.

Further, in the above-described first embodiment, the present invention has been applied to the return channels 52*e*, 53*e*. However, the present invention may be applied to only one of the return channels 52*e*, 53*e*. Still further, the present invention may be applied to at least one of the return channels the same as the return channels 52*e*, 53*e*. This is also the same in the second embodiment.

Third Embodiment

Hereinafter, a description will be given of the third embodiment of the present invention with reference to drawings. In the following description and the drawings used in the description, constituents similar to those which have been already described will be given the same reference numerals, with overlapping descriptions being omitted.

Figure 9:
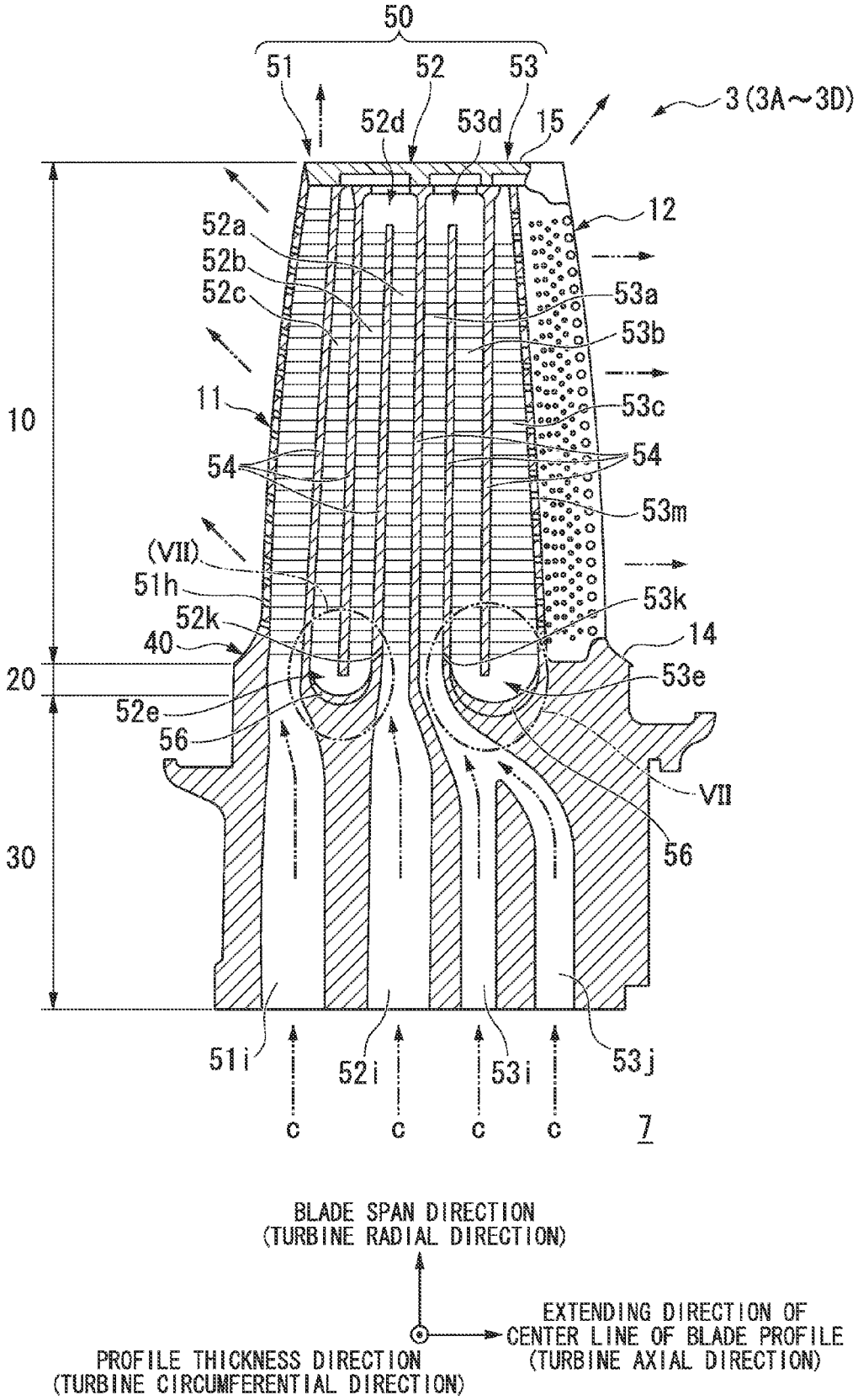
FIG. 9 is a sectional view which shows a turbine blade 3 related to a third embodiment of the present invention that is cut along the center line Q of the blade profile.
Figure 10:
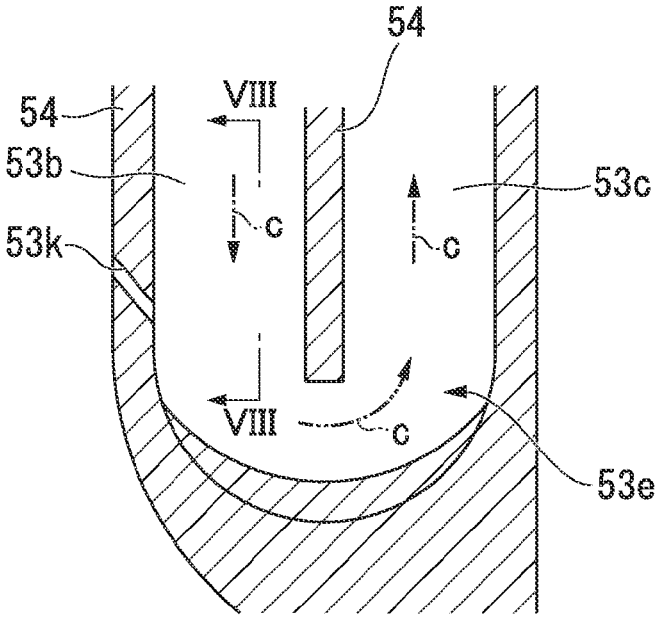
FIG. 10 is an enlarged view which shows a major part in FIG. 9 (an enlarged view which shows a major part VII in FIG. 9).
Figure 10:
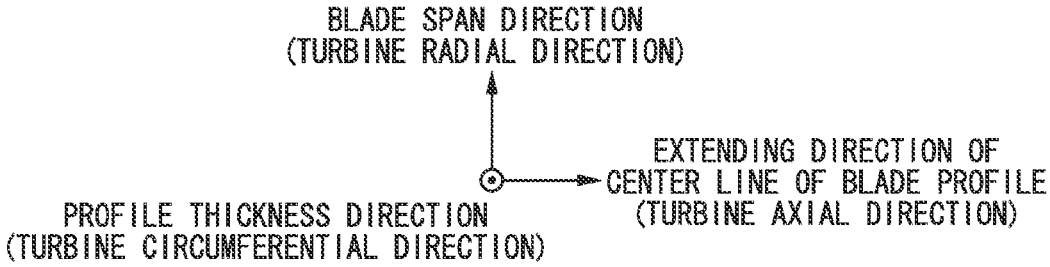
Figure 11:
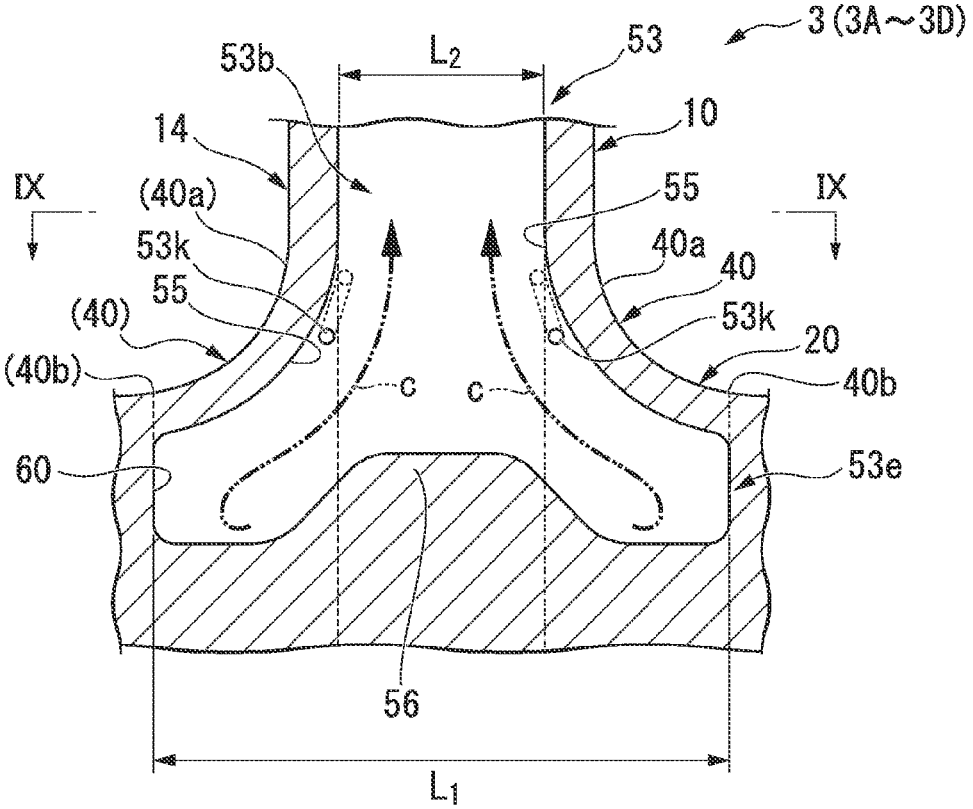
FIG. 11 is a sectional view which shows a cooling channel related to the third embodiment of the present invention, and a sectional view taken along line VIII to VIII in FIG. 10.
Figure 11:
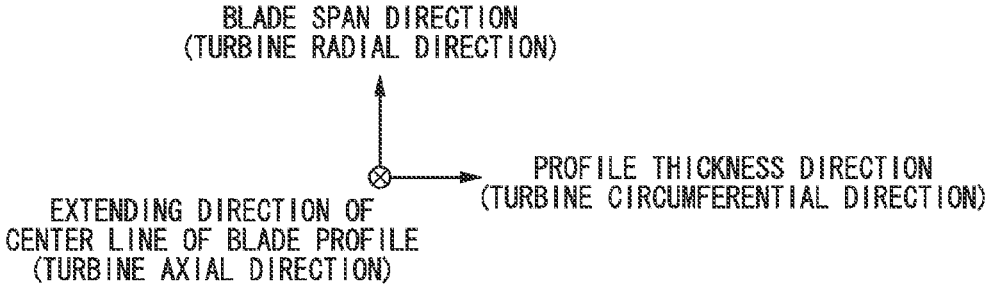
Figure 12:
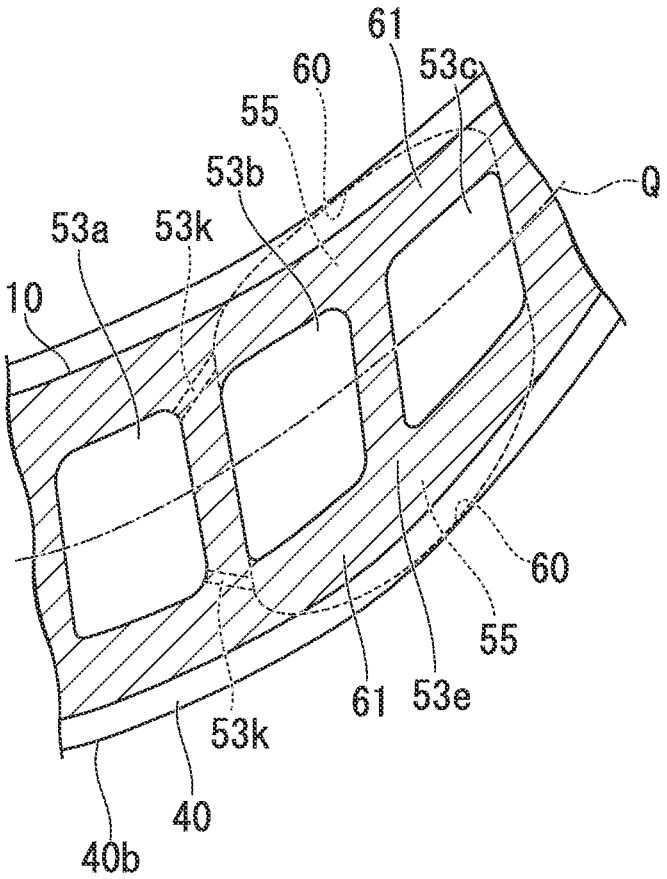
FIG. 12 is a sectional view which shows the cooling channel related to the third embodiment of the present invention, and a sectional view taken along line IX to IX in FIG. 11.
Figure 13:
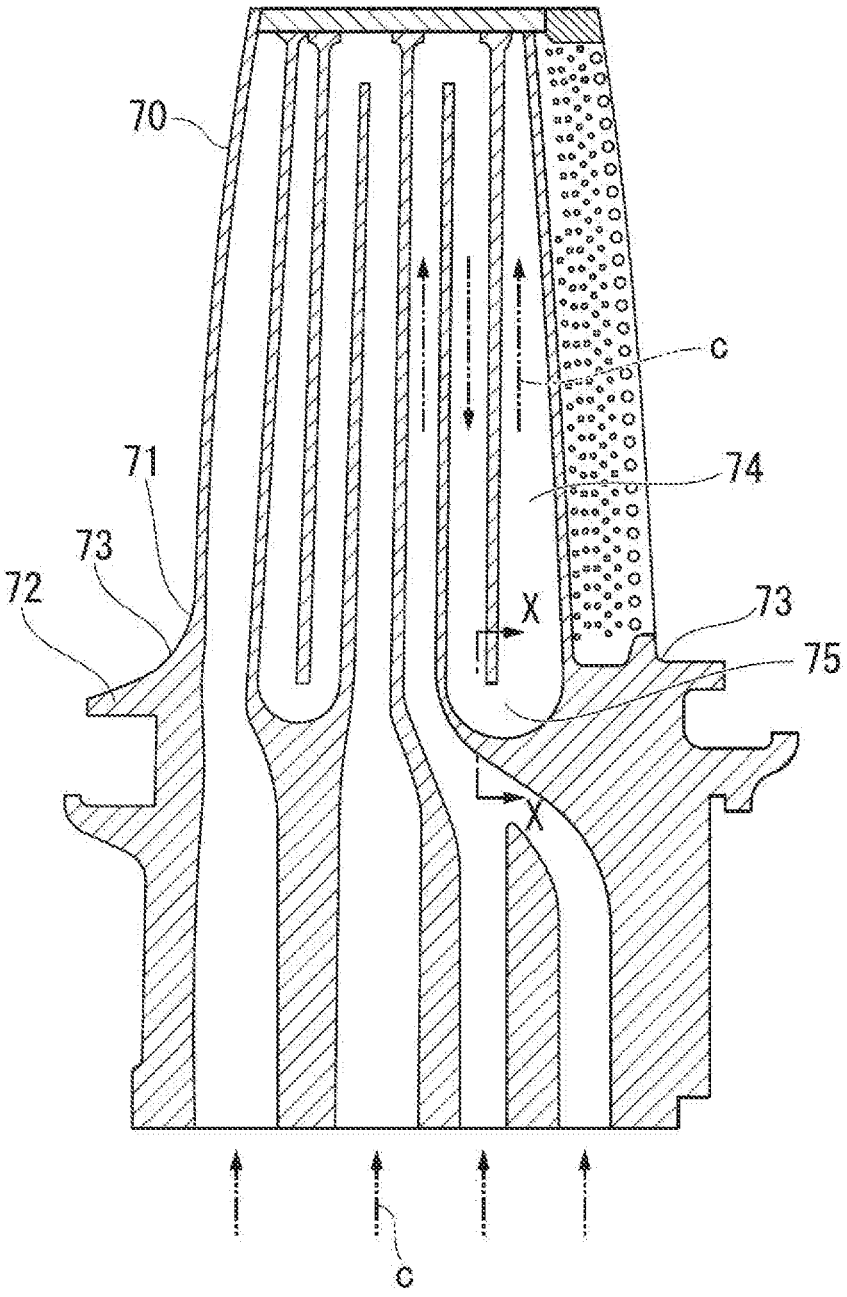
FIG. 13 PRIOR ART
FIG. 13 is a longitudinal sectional view which shows a conventional turbine blade.
Figure 14:
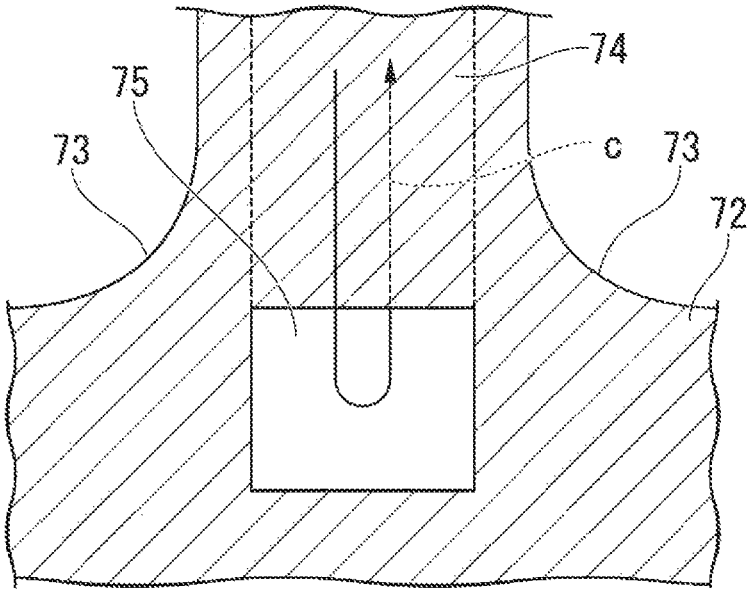
FIG. 14 PRIOR ART
FIG. 14 is a sectional view taken along line X to X in FIG. 13.

The present embodiment is an example in which a cooling hole is provided at a return part of the above-described serpentine channel and applicable to both the first embodiment and the second embodiment. FIG. 9 is a blade sectional view which shows a turbine blade similar to that used in the first embodiment given in FIG. 3. The example shows a case where the cooling hole is provided on the partition wall of the upstream side at an inlet of each return part in a direction at which compressed air c flows. FIG. 10 is an enlarged view which shows a major part of FIG. 9 (an enlarged view which shows the major part VII in FIG. 9). FIG. 11 shows a cross section taken along line VIII to VIII when viewed in the leading edge direction around a return channel 53*e* given in FIG. 10. FIG. 12 shows a cross section taken along line IX to IX around the return channel 53*e* in FIG. 11. With reference to FIG. 9 to FIG. 12, the present embodiment will be described hereinafter by exemplifying the return channel 53*e* of a serpentine channel 53.

Each of FIG. 9 and FIG. 10 shows an example where a cooling hole 53*k* is installed in the proximity of a base end 14 of the serpentine channel 53, that is, on a partition wall 54 which separates between main channels 53*a* and 53*b* and arranged so as to incline to the bottom of the return channel 53*e*.

Further, as shown in FIG. 11, a channel cross section formed with channel inner walls 60 on both sides of the return channel 53*e* in the profile thickness direction is increased in channel width (L1) up to the proximity of the outer edge 40*b* of a fillet portion 40 when viewed from the cross section in the blade span direction, and two cooling holes 53*k* are arranged from the suction side and the pressure side of the main channel 53*b* in such a manner that the compressed air c is blown out toward the channel inner wall 60 which has been increased in width on both sides thereof. Regarding the cooling hole 53*k*, one end thereof is communicatively connected to an upstream side channel of the main channel 53*a* which is on the upstream side of the serpentine channel 53, while the other end is opened to the main channel 53*b* which is on the downstream side.

As shown in FIG. 12, the return channel 53*e* is formed so as to have an enlarged portion 61 which is expanded to the suction side and the pressure side in the profile thickness direction to a greater extent that the main channels 53*b*, 53*c*. The cooling holes 53*k* installed on the suction side and the pressure side are inclined to the center line Q of the blade profile and pointed at a direction at which the compressed air c is in contact with the channel inner wall 60.

As described above, the compressed air c flowing through the serpentine channel is decreased in pressure due to pressure loss occurring during which the compressed air c flows through the channel. For example, in the serpentine channel 53, the compressed air c which is lower in temperature and which has flowed from introduction channels 53*i*, 53*j* into the main channel 53*a* flows from the base end side 14 to the leading end 15, turns at 180° to return at the return part 53*d*, flows further down to the base end 14 and reaches the return part 53*e*, during which the compressed air c is decreased in pressure due to pressure loss inside the channels. That is, there is a certain difference in pressure due to pressure loss between the base end 14 on the upstream side of the main channel 53*a* and the proximity of the inlet of the return channel 53*e* on the downstream side of the main channel 53*b*. Therefore, due to a difference in pressure between the inlet side of the cooling hole 53*k* and the outlet side thereof, part of the compressed air c flowing through the main channel 53*a* flows into the cooling hole 53*k* and is blown into the return channel 53*e*.

According to the present embodiment, there is a possibility that the compressed air c will stay stagnant at the enlarged portion 61 which is expanded in the profile thickness direction on the channel cross section of the return channel 53*e*. However, the cooling hole 53*k* of the present embodiment is provided, by which art of the compressed air c blows out obliquely downward toward the channel inner wall 60 of the return channel 53*e* (radially inward direction). Therefore, the stagnant compressed air which remains at the enlarged portion 61 is purged to the downstream side and the compressed air flow flowing in the proximity of the cooling face 55 of the return channel 53*e* is exchanged to improve the cooling capability of the cooling face 55.

The cooling hole 52*k* is installed on the partition wall 54 between the main channels 52*a*, 52*b* in the return channel 52*e* of the serpentine channel 52 in the same manner, by which a constitution similar to that of the return channel 53*e* is applicable.

Further, the present invention has been applied to the turbine blade 3 of the above-described turbine T and the turbine vane 2 of the turbine T. However, the present invention may be applicable to turbine blades and turbine vanes of various types of rotary machines (for example, turbine blades and turbine vanes of the compressor C (refer to FIG. 1)).

INDUSTRIAL APPLICABILITY

The present invention relates to an airfoil member which is provided with an airfoil body, an end wall which is installed at an end part of the airfoil body in a blade span direction and extends so as to intersect in the blade span direction, a fillet portion which smoothly connects the end part of the airfoil body with the end wall, and a cooling channel which allows a cooling medium to circulate inside the airfoil body and the end wall and in which two main channels extending along the blade span direction are connected so as to bend in a folding manner at a return channel formed on the end wall side. The return channel is formed so as to run along the fillet portion on a cross section intersecting with a center line of a profile of the airfoil body and also formed in such a manner that the width thereof in the profile thickness direction is greater than the width of the main channel in the profile thickness direction. The present invention is able to give uniform and sufficient cooling to the fillet portion.

DESCRIPTION OF REFERENCE NUMERALS

2: Turbine vane (airfoil member)
2*a*: airfoil body
2*b*: Outer shroud (end wall)
2*c*: Inner shroud (end wall)
3 (3A to 3D): Turbine blade (airfoil member)
10: airfoil body
14: Base end (end part)
20: Platform (end wall)
40: Fillet portion
41: Fillet portion
42: Fillet portion
40*a*: Outer surface
50: Cooling channel
52*b*, 52*c*: Main channel
52*e*: Return channel
52*k*, 53*k*: Cooling hole
53*b*, 53*c*: Main channel
53*e*: Return channel
55: Cooling face
56: Projection part
57: Serpentine channel (cooling channel)
57*a* to 57*c*, 57*f*, 57*g*: Main channel
57*d* (57*d*A, 57*d*B), 57*e* (57*e*A, 57*e*B): Return channel
58: Base end (end part)

59: Leading end (end part)
60: Channel inner wall
61: Enlarged portion
C: Compressor (rotary machine)
GT: Gas turbine (rotary machine)
Q: Center line of blade profile
T: Turbine (rotary machine)
c: Compressed air (cooling medium)

The invention claimed is:

1. An airfoil member comprising:

an airfoil body;

an end wall which is installed at an end part of the airfoil body in a blade span direction and extends so as to intersect in the blade span direction;

a fillet portion which smoothly connects the end part of the airfoil body with the end wall; and a cooling channel which allows a cooling medium to circulate inside the airfoil body and the end wall and in which two main channels extending along the blade span direction are connected so as to bend in a folding manner at a return channel formed on the end wall side, wherein the return channel is formed in a flat shape in which a length in the blade span direction is smaller than a length in a profile thickness direction so as to run along the fillet portion on a cross section intersecting with a center line of a profile of the airfoil body, the return channel is provided with an enlarged portion, wherein the width of the enlarged portion in the profile thickness direction is greater than the width of the main channel in the profile thickness direction, and a channel inner wall of the enlarged portion is expanded in the profile thickness direction, the channel inner wall of the enlarged portion is expanded outward from the end part of the airfoil body along a gas path surface of the fillet portion, and the return channel has a base part and a projection part, the projection part is formed at the center of the base part in the profile thickness direction and projects from the base part.

2. The airfoil member according to claim 1, wherein the return channel has a cooling face that is inside the blade along the fillet, the fillet being on the outside of the blade.

3. The airfoil member according to claim 1, wherein the cooling medium is guided to both sides in the profile thickness direction using the projection part.

4. The airfoil member according to claim 1, wherein the return channel is provided with a cooling hole on a partition wall from an upstream side channel of the main channel which is positioned on the upstream side in the return channel.

5. The airfoil member according to claim 2, wherein the cooling face is formed in such a manner that a distance of the cooling face from the outer surface of the fillet portion is substantially the same in distance from the outer surface of the airfoil body to the inner surface of the main channel.

6. The airfoil member according to claim 1, wherein the channel inner wall of the return channel is expanded to the proximity of an outer edge of the fillet portion in the profile thickness direction.

7. A rotary machine which is provided with the airfoil member described in claim 1.

8. The airfoil member according to claim 1, wherein on the cross section intersecting with the center line of the profile including a partition wall which separates the main channel, the channel inner wall of the return channel is expanded to a suction side and a pressure side with respect to a tangent to the radial direction of the channel inner wall in an inner or outer circumference end of the main channel, wherein the main channel is connected to the return channel.

* * * * *